US006250299B1

(12) United States Patent
Danisch et al.

(10) Patent No.: US 6,250,299 B1
(45) **Date of Patent: *Jun. 26, 2001**

(54) PROTECTIVE SYSTEM FOR FACE AND RESPIRATORY PROTECTION

(75) Inventors: Susan G. Danisch, Vadnais Heights; Michael R. Berrigan, Oakdale; Patrick H. Carey, Jr., Bloomington, all of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/399,539

(22) Filed: Sep. 20, 1999

Related U.S. Application Data

(63) Continuation of application No. 08/911,833, filed on Aug. 15, 1997, now Pat. No. 6,014,971.

(51) Int. Cl.[7] ..... A62D 7/10; A62D 19/00; A62D 23/02

(52) U.S. Cl. ..... 128/201.25; 128/201.22; 128/201.23; 128/201.24; 128/205.29

(58) Field of Search ..... 128/201.22, 201.23, 128/201.24, 201.25, 201.29, 205.12, 205.27, 205.29; 2/171.3, 202, 205, 206, 422, 424, 434

(56) References Cited

U.S. PATENT DOCUMENTS

| | | | | |
|---|---|---|---|---|
| D. 357,555 | * | 4/1995 | Brueckner | D29/106 |
| 2,364,571 | * | 12/1944 | Turner | 2/9 |
| 3,362,403 | * | 1/1968 | Fleming et al. | 2/9 |
| 3,600,713 | * | 8/1971 | Holt | 2/3 |
| 3,713,640 | * | 1/1973 | Margan | 267/117 |
| 3,906,548 | * | 9/1975 | Kallis | 2/181.4 |
| 3,934,271 | * | 1/1976 | Rhee | 2/9 |
| 3,955,570 | | 5/1976 | Hutter . | |
| 3,992,722 | * | 11/1976 | Rhee | 2/424 |
| 4,019,508 | | 4/1977 | Der Estephanian et al. . | |
| 4,055,173 | | 10/1977 | Knab . | |
| 4,058,854 | * | 11/1977 | Rhee | 2/412 |
| 4,279,038 | * | 7/1981 | Bruckner et al. | 2/425 |
| 4,280,491 | | 7/1981 | Berg et al. . | |
| 4,286,339 | * | 9/1981 | Coombs | 2/414 |
| 4,287,613 | * | 9/1981 | Schulz | 2/413 |
| 4,453,277 | * | 6/1984 | Durand et al. | 2/416 |
| 4,462,399 | | 7/1984 | Braun . | |
| 4,676,236 | * | 6/1987 | Piorkowski et al. | 128/201.23 |
| 4,901,716 | | 2/1990 | Stackhouse et al. . | |
| 4,965,887 | | 10/1990 | Paoluccio et al. . | |
| 5,003,973 | * | 4/1991 | Ford et al. | 128/201.25 |
| 5,054,479 | * | 10/1991 | Yelland et al. | 128/201.25 |
| 5,104,430 | * | 4/1992 | Her-Mou | 55/385.1 |
| 5,125,402 | | 6/1992 | Greenough . | |
| 5,177,815 | * | 1/1993 | Andujar | 2/411 |

(List continued on next page.)

FOREIGN PATENT DOCUMENTS

| | | |
|---|---|---|
| 0 338 714 A2 | 10/1989 | (EP) . |
| 2 032 284 | 5/1980 | (GB) . |
| 2 061 696 | 5/1981 | (GB) . |
| WO 93/10858 | 6/1993 | (WO) . |
| WO 95/01739 | 1/1995 | (WO) . |

*Primary Examiner*—Glenn K. Dawson
*Assistant Examiner*—Joseph F Weiss, Jr.
(74) *Attorney, Agent, or Firm*—Michaele A. Hakamaki

(57) ABSTRACT

The present invention provides a portable protective system for protecting a wearer, and for protecting the environment about the wearer. The protective system includes a face shield coupled with a head cradle for supporting the face shield on the wearer's head. The face shield and a wearer's face substantially define a breathing zone charged by a battery-powered blower carried on the head cradle. An bag-like inlet filter element encompasses the blower to provided filtered air to the breathing zone, and an outlet filter element is operably associated with the face shield.

6 Claims, 6 Drawing Sheets

U.S. PATENT DOCUMENTS

| | | | | |
|---|---|---|---|---|
| 5,315,718 | | 5/1994 | Barson et al. . | |
| 5,381,560 | | 1/1995 | Halstead . | |
| 5,410,757 | * | 5/1995 | Vienamo et al. | 2/9 |
| 5,533,500 | * | 7/1996 | Her-Mou | 128/201.25 |
| 5,588,153 | * | 12/1996 | Ignon et al. | 2/457 |
| 5,592,936 | | 1/1997 | Thomas, Jr. et al. . | |
| 5,659,900 | * | 8/1997 | Arney et al. | 2/417 |
| 5,774,901 | * | 7/1998 | Minami | 2/421 |
| 6,014,971 | * | 1/2000 | Danisch et al. | 128/201.25 |

* cited by examiner

PROTECTIVE SYSTEM FOR FACE AND RESPIRATORY PROTECTION

This is a continuation application Ser. No. 08/911,833, filed Aug. 15, 1997, now issued as U.S. Pat. No. 6,014,971.

TECHNICAL FIELD

The present invention relates to protective systems designed to provide combined respiratory and/or impact and splash protection for the user and protection to the environment from the wearer's exhalation. More particularly, it relates to lightweight, positive/negative pressure respiratory and protection devices.

BACKGROUND

In recent years, it has become increasingly important to protect the health of care providers without compromising that of the patient. This reflects the increasing incidence of such infectious diseases as tuberculosis, acquired immune deficiency syndrome, and herpes. Many factors should be considered in selecting a proper protection device. For example, verbal, as well as visual communication between a care provider and a worried patient can be critical in reassuring and displaying concern to the patient. Furthermore, in an emergency situation, a protective system that is easy to don and does not need facial or cranial adjustment saves time. In addition, a protective device should be comfortable to wear for long periods of time.

Generally, while masking and shielding protective systems, including masks and respirators, known prior to the present invention provide a high level of protection, they are difficult to put on and properly adjust. Furthermore, these devices may be uncomfortable to wear, even for short periods of time. Additionally, many conceal part or all of the wearers' face, particularly the mouth.

Protective systems incorporating ventilation or ventilation systems are known. U.S. Pat. No. 4,055,172 (Knab) discloses the use of a vacuum system to draw air into and through the protective helmet and gown of the surgeon and to filter that air prior to returning it to the room. The lack of mobility created by the need to tether the user to the device is not desirable, and there is no mention of the need to protect the user from contaminants in the room. The issue of mobility is addressed by U.S. Pat. No. 4,019,508 (Der Estephaniuan, et al.). It describes a "back pack" self-contained device to be worn by surgeons. However, wearing a back pack may create balance, awkwardness and fatigue problems for the user and, again, there is no mention of protecting the user from contaminants in the ambient air.

Positive pressure respirators are broadly used in industrial applications. Their use is frequently regulated by government agencies. These devices provide filtered air to a user. A compressed air line or a blower is used to deliver the air to the hard-hat helmet or face piece of the respirator. U.S. Pat. No. 4,462,399 (Braun) discloses a "filter in helmet" concept, wherein a face sealing means is used to seal the device against the face. As disclosed in U.S. Pat. No. 4,280,491 (Berg et al.), air exit openings may be provided to allow air to flow out of the device. Such devices are also described in a 3M brochure entitled "Positive Pressure Respirators" (3M, St. Paul, Minn.). The intent of such devices is to protect the wearer from the environment, and no provision is made to remove wearer originated contamination from the positive pressure system before the air exits to the environment.

Protection of the face including the eyes, nose, ears and mouth is taught in U.S. Pat. No. 4,965,887 (Paoluccio et al.).

This device uses a generally cylindrical clear plastic face shield held in position by associated eye glasses. The patent also suggests the attachment of the shield to a hard hat or to other forms of head gear. The use of an extended skirt attached to the bottom of the shield is suggested for further protection of the wearer. Openings on the top and bottom of a fluid impermeable skull cap are provided for relief from the heat built up from wearing the device. No respiratory protection is provided to the wearer.

Protective masking and shielding systems for protecting and covering the head and/or face of the wearer have employed an adjustable harness to secure a hard-hat and/or face-shield protective device to the head of the wearer. These harnesses combine a horizontal head band encircling the head with a head band that extends from side to side over the crown of the head. The protective devices are suspended from or mounted on the harness. Typical harnesses used to secure a helmet system to the head of the wearer are described in U.S. Pat. Nos. 3,955,570 (Hutter), 4,280,491 (Berg et al.), 4,901,716 (Stackhouse et al.) and 5,125,402 (Greenough). Such harnesses are widely used in industry and construction. A ratchet device (e.g., Hutter or Stackhouse et al.) may be used to tighten the head band which, typically, exerts pressure on the head over a small surface area. Pressure sufficient to prevent inadvertent movement of the helmet may be uncomfortable and harnesses may cause disarrangement of the hair and pressure marks on the head and/or forehead.

U.S. Pat. No. 5,381,560 (Halstead) describes a fitting and retention system for headgear including foam pads attached to a plastic (such as expandable polystyrene) liner. The liner is secured to the cranium by means of an adjustable nylon strap which can be positioned to "snugly engage" the occipital protuberance of the head. The intent of the helmet is to protect the head of a bicycle rider in the event of a fall. No mention is made of other applications or uses.

Valves are typically affixed to respiratory protective devices to prevent contaminated air from entering the breathing zone during the inhalation cycle as described in U.S. Pat. No. 5,325,892 (Japuntich et al.). As disclosed in the above-noted Stackhouse et al. patent, unidirectional valves may also be used in clean room devices to prevent contamination of the environment.

SUMMARY

There is a need for a protective system that is light, easy to don and remove, comfortable, provides panoramic viewing, supplies clean inhalation air, and filters exhaled air.

The present invention provides a novel protective device that protects a wearer from particulate aerosols, droplets of blood and other body fluids. The device may provide cooling filtered air, as well as remove humidity buildup. It also protects the environment in which the wearer is working from contamination by the wearer. It allows health care patients and others to perceive the interest and concern of the wearer. The device can also be adapted to provide protection from gases and vapors. In addition to use in the health care field, the protective device of the present invention may be used in the food, pharmaceutical, semi-conductor and other industries. The device may be portable or may be tethered or fixed to an air source.

The protective system has a head cradle and a substantially transparent lens-like face protecting shield member coupled to the head cradle. The face protecting shield member may be splash and/or impact resistant.

The head cradle is curved and generally conforms to the top and back of a user's head. The head cradle is a support member for supporting a protective device, in this instance a face shield, on a wearer's head. The cradle may accommodate a large variety of head sizes. All or a portion of the cradle is resilient to provide a spring-like effect that firmly grips the head in a gentle, compressive manner. The compressive effect is generated basically between two points, a portion of the protective device complimentary to the forehead of the wearer (i.e., generally at the forehead of the wearer) and the free end of the head cradle which lodges generally under the occipital protuberance when the device is in use (i.e., generally at the back of the wearer's head, beneath the occipital protuberance).

The device may also be supported by a head harness. Alternatively, the head cradle may be used in conjunction with a head harness, such as in a hard hat application.

The face shield and the wearer's face substantially define a breathing zone charged by an airflow generator or blower operably carried on the head cradle. A pressurized air source may be coupled to or used instead of the blower.

The blower may be powered by different power sources but is preferably electrically powered. An electrical current producer such as a battery or solar array is preferred. Directly wired line voltage could be used.

A filter may be associated with the blower. In a preferred embodiment, the filter encompasses the blower and power source. The preferred filter concept and arrangement of the present invention, wherein a bag-like filter encompasses a blower, may be used in virtually any forced air system, although it is particularly well-suited for applications in which compactness and weight are considerations.

A spacer may be carried near the inlet for spacing the filter from the inlet. The blower and filter feature of the present invention may be used with a typical hard hat harness or to improve currently available protective systems.

The protective system of the present invention may also include a diffuser. Preferably, diffuser has a front surface, a rear surface, an air entry, an air exit and a plurality of internal baffles. The diffuser defines an air flow path. The rear surface preferably is generally complementary to a human forehead and may carry an air-impermeable band. The face shield is coupled to the diffuser and the head cradle extends generally rearward from the diffuser. The blower or airflow generating device is coupled to the diffuser for generating an air flow through the diffuser.

The face shield may carry an exit filter seal for filtering air before it is exhausted from the breathing zone. The exit filter seal is generally pliable and is operably coupled to and disposed along the periphery of the face shield. It is adapted to generally engage and conform to the boundaries of a human head. When the system is being worn, together the face shield, the surface of the face and the exit filter seal form a breathing zone charged with clean air.

The protective device of the present invention is light in weight, easy to don and remove, comfortable to wear, provides panoramic viewing, filters exhaled air and supplies filtered inhalation air. It can be used by bearded people, and by people who wear eyeglasses. It is well adapted to provide reciprocal protection for health care workers and patients, and reduces potential contamination from the wearer.

It is believed that the system of the present invention, and its features, can be manufactured at substantially lower cost than existing forced air devices and, thus, will allow for broader and more frequent use in hospital, clinical, industrial, and office settings.

These and other features, embodiments and advantages of the present invention will become more apparent with reference to the accompanying drawings, the description of the preferred embodiment and the appended claims.

DETAILED DESCRIPTION

In describing the preferred embodiments of the invention, specific terminology is used for the sake of clarity. The invention, however, is not intended to be limited to the specific terms so selected, and it is to be understood that each term so selected includes all technical equivalents that operate similarly.

As used herein, the term "face" is intended to have its customary meaning, i.e., the anterior part of the human head generally from forehead to chin and extending laterally to, but not including, the ears. The face includes the chin, mouth, nose, cheeks, eyes and, usually, the forehead.

As used herein, the term "head" is intended to have its customary meaning but may also include portions of the neck and shoulders.

Any references herein to front and back, right and left, top and bottom, upper and lower and horizontal and vertical are intended for convenience of description only, not to limit the present invention or its components to any one positional or spatial orientation. Such terms are to be read and understood with their conventional meanings.

The present invention may be used a splash or impact protection device. Additionally, the device may provide respiratory protection, either through positive or negative pressure, to the wearer. The invention may also provide protection to a non-wearer against contaminants in a wearer's exhalation.

The Figures depict the protective face shielding and breathing system 20 of the present invention, and features and components thereof. Although the system 20 is very well-suited for use in the health care industry, the system 20 could be used in many other fields, in virtually any situation in which it might be desirable to isolate a person from the environment, e.g., in the pharmaceutical, chemical, electronics industries.

Figure 1:
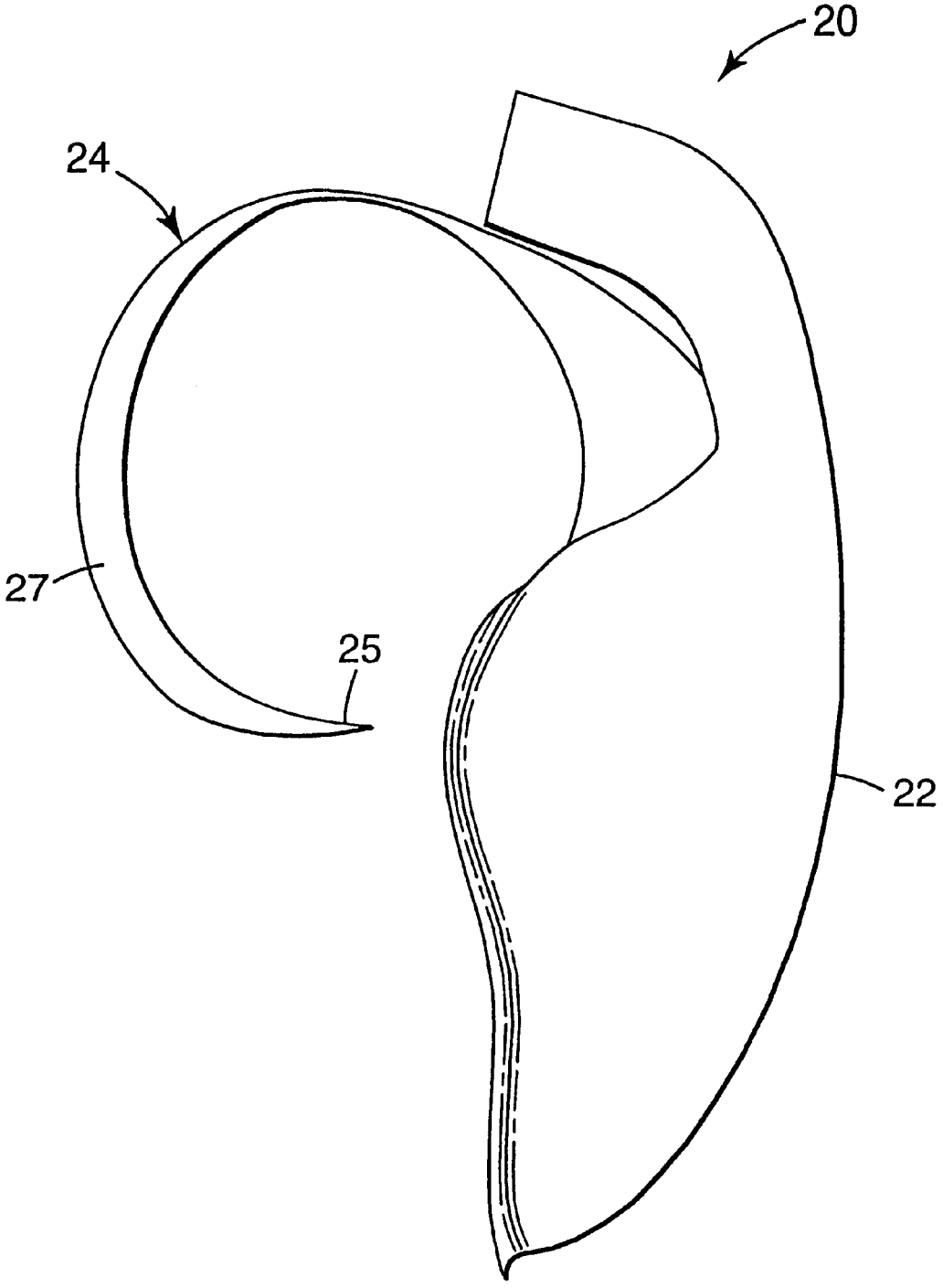
FIG. 1 is a side view of one embodiment of the protective system of the present invention.

Referring to FIG. 1, the present invention provides a protective system 20 having a face shield 22 coupled to a cradle 24. The face shield 22 may provide splash and /or impact resistance. Preferably, the face shield 22 is transparent and provides a wide field of view. A face shield 22 that provides a panoramic view is preferred.

The face shield 22 may be made of any suitable material and of any size or shape that provides the desired level of splash and impact resistance. In the present invention, clear polycarbonate is a preferred material. However, one skilled in the art will recognize that a variety of materials may be used. Similarly, a variety of shapes and sizes may be employed in the present invention. In at least one embodiment, the face shield 22 is formed to generally conform to the shape and exceed the size of the human face. The face shield 22, or lens, could be movably or hingedly coupled to the head cradle, and it could be formed of two or more hingedly coupled pieces so that, for example, to drink something without removing the protective system a wearer could open a lower portion (for example) of the face shield 22.

Figure 2:
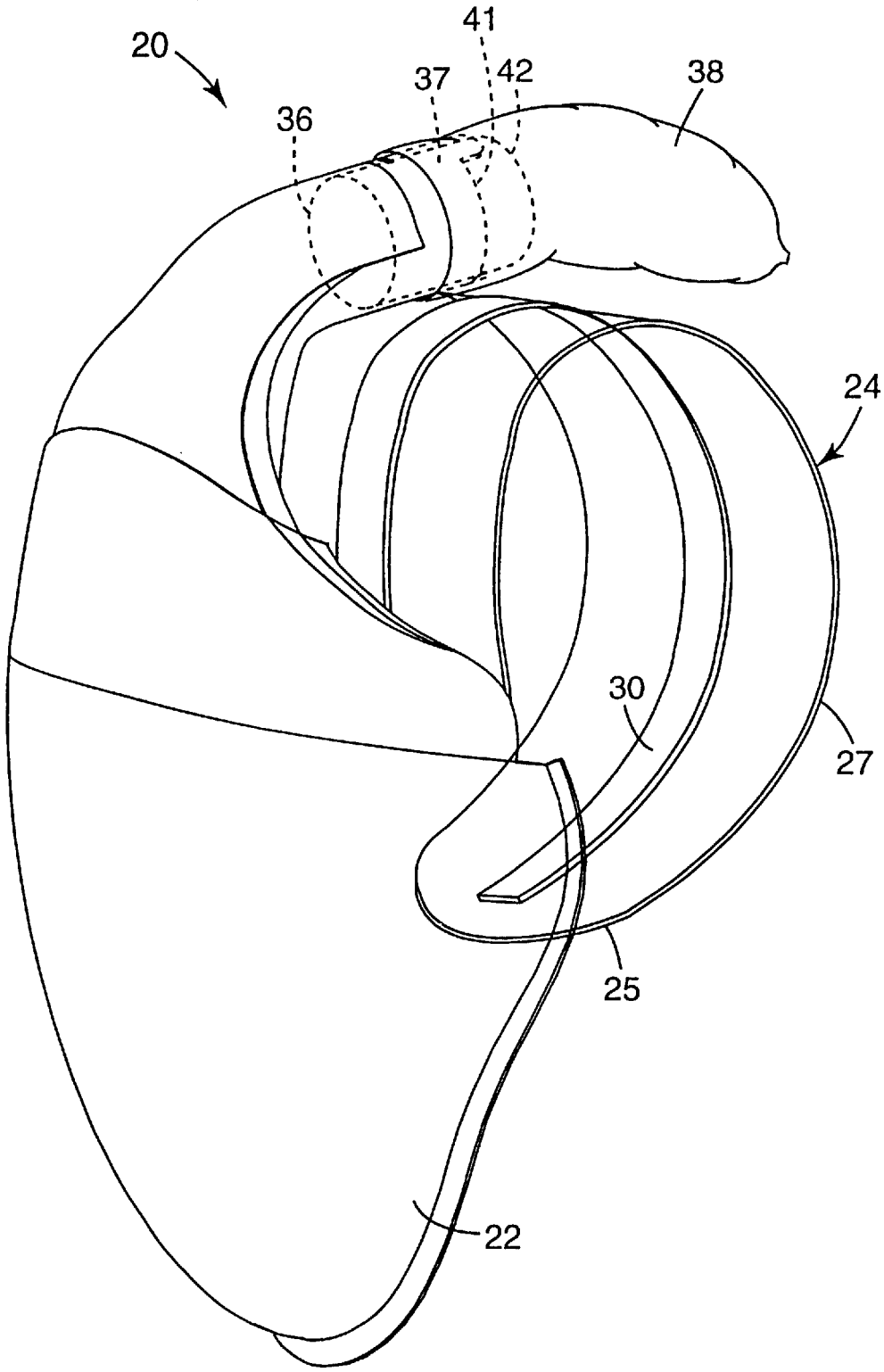
FIG. 2 is a side perspective view of one embodiment of the present invention.

Referring to FIGS. 1 and 2, face shield 22 is attached to head cradle 24. Cradle 24 is a generally curved or arcuate, spatulate shape. The cradle 24 may be fastened to head shield by a number of means, including adhesive, screws or springs. The cradle has a free end 25 and a length 27 extending generally between the free end 25 and the attachment to the face shield 22. The head cradle 24 is shaped to generally conform to and provide a snug fit against the head of the wearer.

Cradle 24 is made of a resilient material. All or a portion of its length 27 may be resilient. In a preferred embodiment, the material is a clear polyester. Other suitable materials include plastics such as polyolefins and ABS and metals such as spring steel. The resilience may be enhanced by using springs or other similar structures. The cradle 24 is sufficiently resilient to permit the free end 25 to generally engage the bottom of occipital protuberance of the wearer's head when in use.

With continuing reference to FIG. 2, a reinforcing strip 30 may be added to the cradle 24. The reinforcing strip 30 preferably is resilient and may be made of many suitable materials, such as spring steel, In use, cradle 24 exerts a gentle, compressive pressure against the wearer's head. The pressure is generally generated by the free end 25 of the cradle 24 and a portion of the protective device generally in the vicinity of where the device contacts the wearer's forehead. In the preferred embodiment, the pressure exerted is sufficient to hold the face shield 22 in place in front of the wearer's face but not so great as to leave substantial pressure marks on the wearer's head.

The cradle 24 may be used in other applications, such as, for instance, welding applications. In this case, the cradle 24 would be attached to a welding shield.

Figure 5:
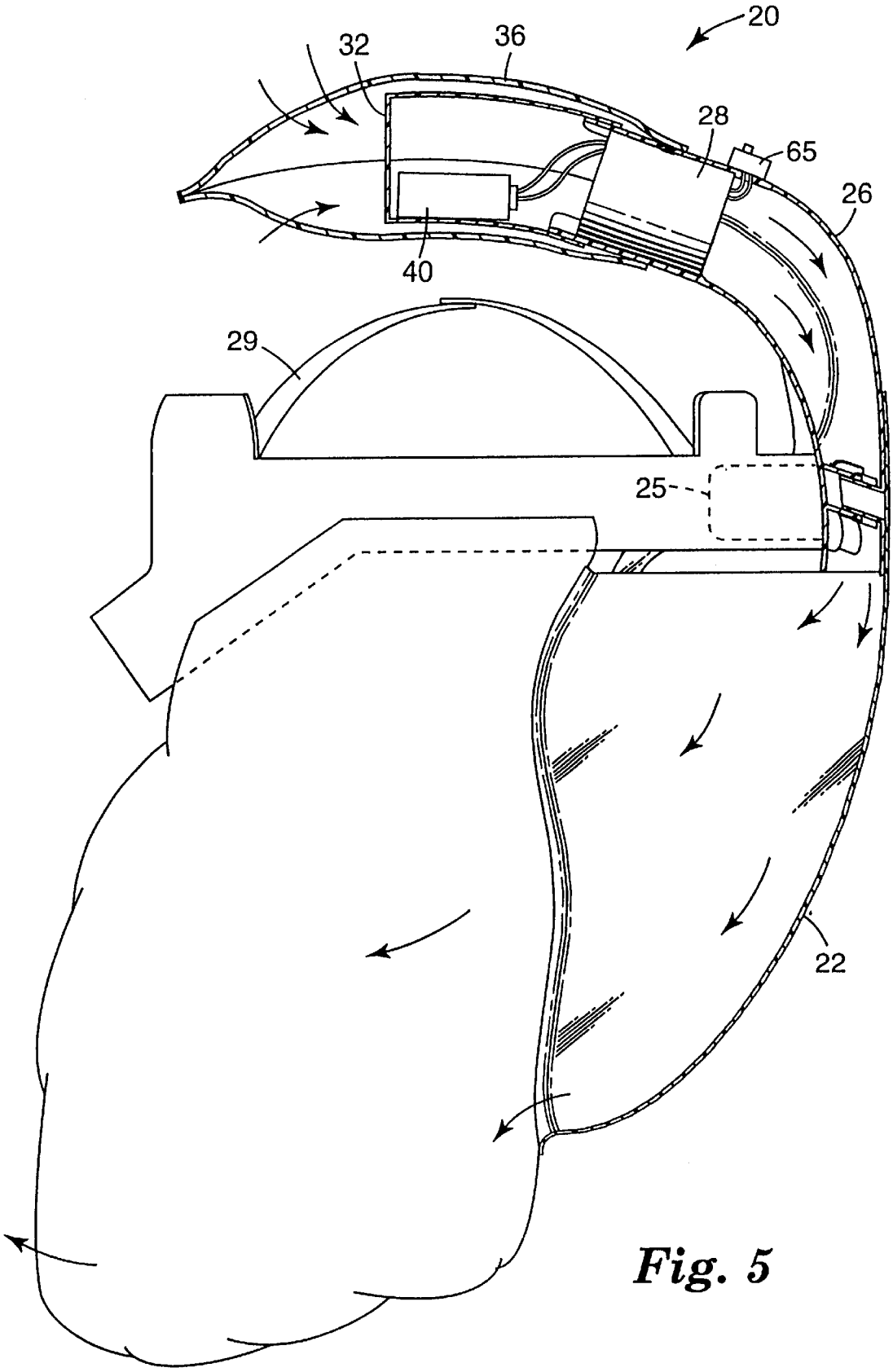
FIG. 5 depicts another embodiment of the present invention having a harness and a cowl.

As depicted in FIG. 5, a harness 29, may be used instead of cradle 24. Harness 29 may be adapted from any suitable commercially available harness and may carry an air impermeable band 51.

Figure 3:
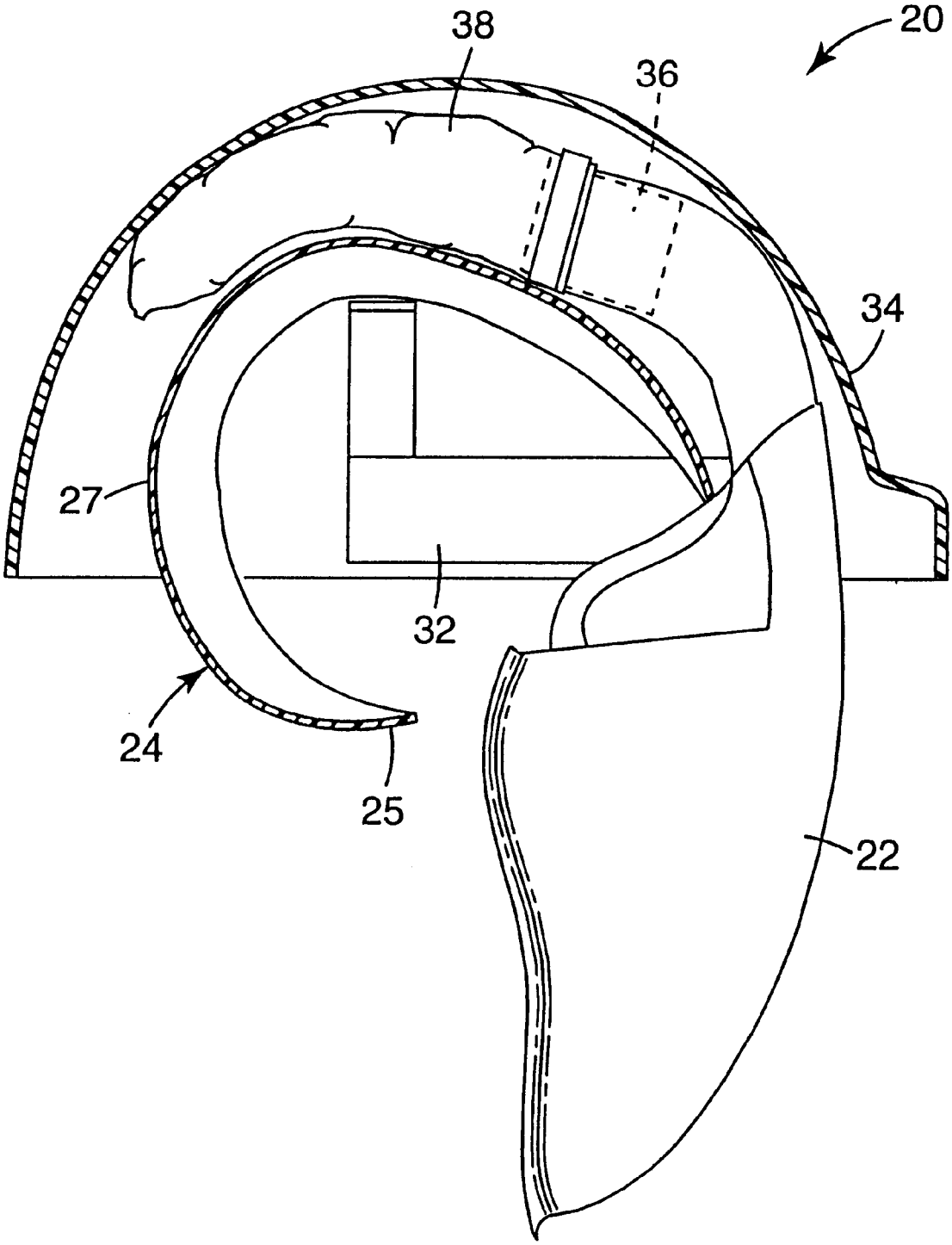
FIG. 3 depicts the head cradle, face shield, and blower/filter bag feature of the present invention adapted for use with a hard hat.

Referring to FIG. 3, when the device 20 is to be used in conjunction with additional equipment, such as a hard hat 34, cradle 24 may include a head harness 32. The head harness 32 stabilizes the face shield 22 on the wearer's head and may articulate with the additional equipment to connect the device 20 to the equipment. The head harness 32 may either be part of the additional equipment or be part of the cradle 24.

Figure 4:
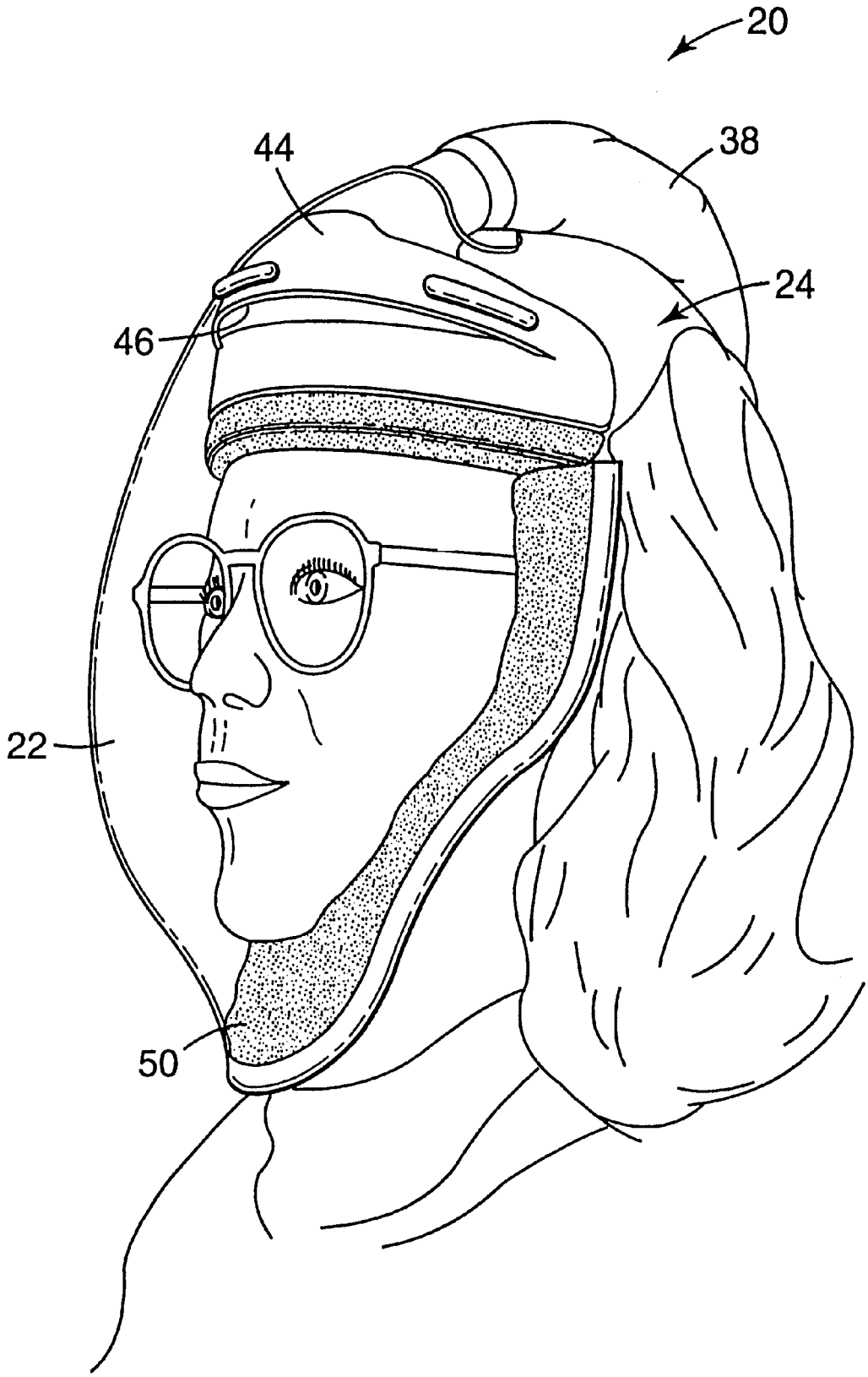
FIG. 4 depicts an embodiment of the present invention in use.

Referring to FIG. 4, the face shield 22 and the wearer's face substantially define a breathing zone. With reference to FIG. 5 (wherein the arrows depict air flow) and continuing reference to FIG. 4, this zone may be charged by an airflow generator 36, such as a blower, operably carried on the head cradle 24 or operably connected with a diffuser 44. The airflow generator 36 has an intake 37 with an inlet 41 and an outlet 39. The air flow generated by airflow generator 36 can be selectively increased or decreased. When the blower is activated, the flow rate is preferably above about 50 liters per minute, with a range of approximately 110 to 170 liters per minute being most preferred. An example of a suitable airflow generator 36 is a model W-2949 motor/blower (Minnesota Mining & Manufacturing Company, St. Paul, Minn., hereinafter referred to as "3M"). A pressurized air source may be attached to device instead or in conjunction with the airflow generator 36.

A filter 38 is connected to the intake 37 to provide filtered air to the breathing zone. Preferably, filter 38 is a multilayer material, having an outer protective layer(s), such as a scrim layer encompassing an inner filter layer(s), such as a microfiber layer. In a preferred embodiment, the filter 38 is a pliable encompassing member. The bag-like filter 38 substantially encompasses at least the blower inlet 41. Examples of suitable filter materials may be found by reference to U.S. Pat. Nos. 5,620,545 (Braun et al.) and 5,639,700 (Braun et al.), both assigned to 3M. The filter may be of varying degrees of flexibility, even approaching substantial rigidity, and may have various stiffness. The filter element may include more rigid portions for making it self-supporting in a selected configuration or position with respect to air intake 37 or air inlet 41, or a frame may be provided for this purpose. More than one filter element may be used. Other nonencompassing filters, such as the SERIES 2000 filters by 3M, are suitable for the present invention.

Intake may be a port, as depicted in FIG. 2, or may be a permeable or impermeable support structure as shown in FIG. 5.

The blower 36 may be battery powered or powered by other sources. The air flow generator 36 is preferably electrically powered, an electrical current producer such as a battery or solar array being operably associated with the air intake. Directly wired line voltage could be used. In a preferred embodiment, the power source 40 is contained within filter 38.

Suitable controls may be provided for the blower, such as a rheostat, slide, toggle or touch on/off switch.

With reference to FIG. 2, a spacer 42 may operably be carried near the inlet 41 for spacing the filter 38 from the intake 37.

Figure 6:
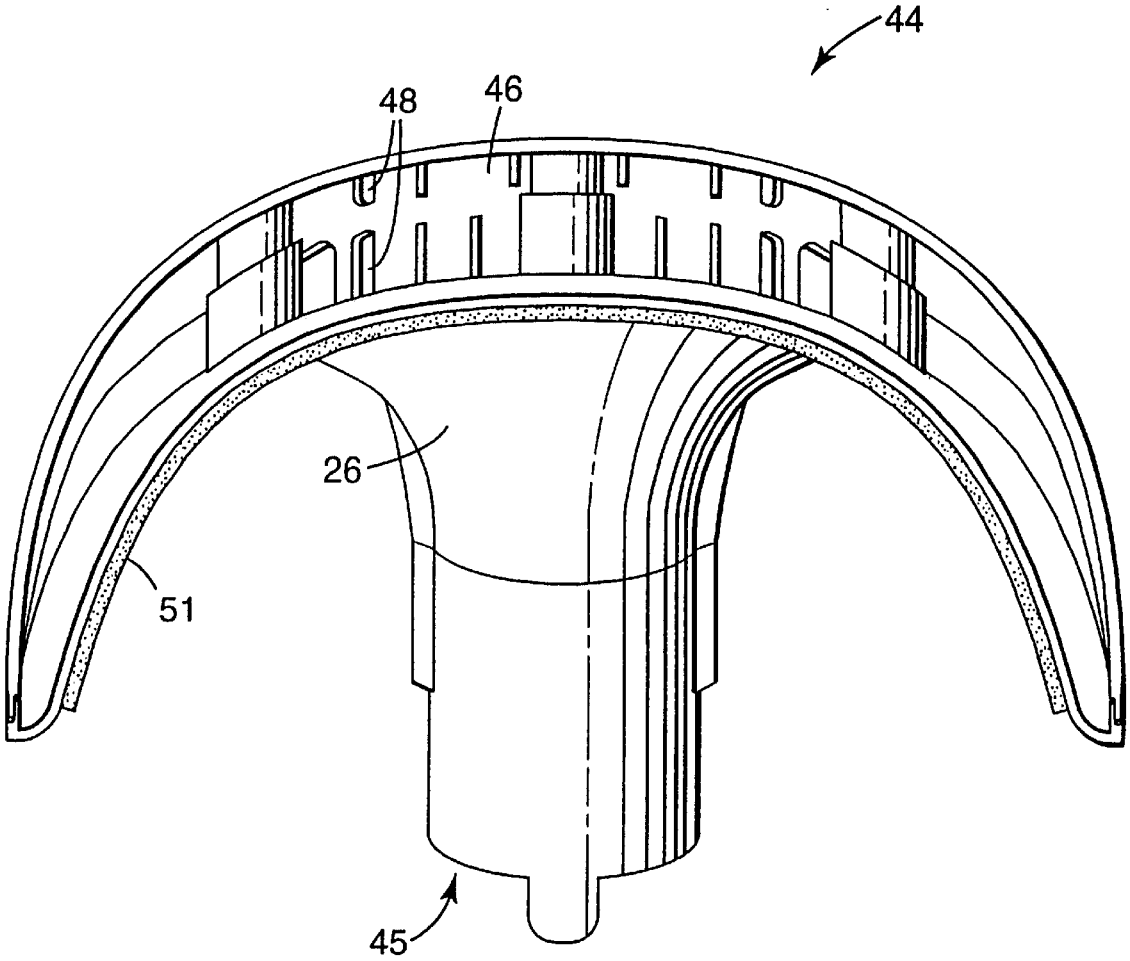
FIG. 6 is a bottom plan view of the diffuser of the present invention, including the internal baffle structure thereof.

With reference to FIG. 6, the portable protective system of the present invention may include a diffuser 44 with an air entry 45 an air exit 46 and a plurality of internal baffles 48. The diffuser 44 defines an air flow path. The surface 26 of diffuser 44 near the air exit 46 is generally complementary to a human forehead. An air-impermeable band 51 may be provided on the diffuser and/or the cradle 24 or face shield 22 to help seal the device to the wearer. Diffuser 44 is coupled to face shield 22. Head cradle 24 extends generally rearward from the diffuser 44.

With reference to FIG. 4, face shield 22 may carry an exit filter seal 50 for filtering air before it is exhausted from the breathing zone. The exit filter seal 50 is generally pliable and is operably coupled to and disposed along all or part of the periphery of the face shield 22. Exit filter is adapted to generally engage and conform to the boundaries of a human face.

The exit filter seal 50 substantially occupies or fills the space between the face shield and a wearer's face, thereby forming a breathing zone defined by the face shield 22, the surface of the wearer's face, and the exit filter seal 50. The exit filter seal 50 prevents the inward flow of unfiltered ambient air while permitting air to be exhausted through the seal from the breathing zone. Examples of material suitable for forming the exit filter seal 50 include TYVEK by DuPont, or other generally similar woven or nonwoven webs. A carded, thermally bonded nonwoven web comprised of 3 denier polypropylene and polyester fibers is suitable, but a generally similar woven or nonwoven web or a foam material may be used, as long as the selected material precludes contaminated or ambient air from entering the breathing zone. The exit filter seal 50 may be adhesively or mechanically attached along the perimeter of the face shield portion 22 using, for example, 3M tape #924. The exit filter seal 50 is used in protective devices wherein filtered exhalation is required or desired.

More than one exit filter seal 50 may be used, and the pliability of the exit or exhalation filter(s) may be varied.

A filter cowl 60 may be used with the present invention. In use, the filter cowl 60 drapes loosely from the edge of the face shield 22, substantially occupying or covering the space between the face shield 22 and the user's head particularly the space between the shield 22 and the periphery of a user's face. This defines a breathing zone. The cowl 60 may be disposable, designed for a single use, i.e., to be removed after a use and replaced with another cowl. The cowl 60 may be used in conjunction with or instead of the exit filter seal 50.

Although a description of preferred embodiments have been presented, various changes, including those mentioned above, could be made without deviating from the spirit of the present invention. It is desired, therefore, that reference be made to the appended claims rather than to the foregoing description to indicate the scope of the invention.

What is claimed is:

1. A protective system, comprising: a diffuser having a surface, an air entry, an air exit, and at least one internal baffle, said diffuser defining an air flow path, said surface generally complementary to a human forehead;

a substantially transparent face shield coupled to the diffuser;

a head cradle extending from the diffuser, said head cradle having a free end and a length extending generally between the free end and the diffuser, a portion of the length being sufficiently arcuate whereby, when in use, a portion of the head cradle generally conforms to a wearer's top and back head regions, the head cradle extends generally toward the wearer's occipital protuberance and said free end is adapted to engage the wearer in a region generally beneath the occipital protuberance;

a blower coupled to the diffuser for generating an air flow through the diffuser, said blower having an inlet and said blower operably coupled to a power source; and a filter operably coupled to the diffuser.

2. The protective system according to claim 1, further comprising a generally pliable exit seal operably coupled to and disposed along the periphery of the face shield and adapted to generally engage and conform to the boundaries of a human head, thereby forming a breathing zone defined by the face shield; the surface of the human face and the exit seal.

3. The protective system according to claim 2, wherein the exit seal comprises a nonwoven web connected to the face shield.

4. The protective system according to claim 2, wherein the exit seal comprises a nonwoven web of polypropylene and polyester fibers attached to the face shield.

5. The protective system according to claim 1, wherein the blower provides an air flow of approximately 100 to 170 liters per minute.

6. The protective system according to claim 1, wherein the filter is a compliant, encompassing filter that at least substantially encompasses the blower inlet.

* * * * *